US005639126A

United States Patent [19]

Dames et al.

[11] Patent Number: 5,639,126

[45] Date of Patent: Jun. 17, 1997

[54] MACHINE READABLE AND VISUALLY VERIFIABLE SECURITY THREADS AND SECURITY PAPERS EMPLOYING SAME

[75] Inventors: Andrew Dames; Geraint Davies, both of Cambridge, United Kingdom; Alaric Naiman, Lincoln, Mass.

[73] Assignee: Crane & Co., Inc., Dalton, Mass.

[21] Appl. No.: 469,482

[22] Filed: Jun. 6, 1995

[51] Int. Cl.[6] ..... B42D 15/00

[52] U.S. Cl. ..... 283/83; 283/72

[58] Field of Search ..... 283/83, 82, 72, 283/901, 117, 107

[56] References Cited

U.S. PATENT DOCUMENTS

| | | | |
|---|---|---|---|
| 4,183,989 | 1/1980 | Tooth . | |
| 4,290,630 | 9/1981 | Lee | 283/83 X |
| 4,579,371 | 4/1986 | Long et al. . | |
| 4,609,207 | 9/1986 | Muck et al. | 283/83 X |
| 4,763,927 | 8/1988 | Schneider | 283/83 X |
| 4,943,093 | 7/1990 | Melling et al. . | |
| 5,176,405 | 1/1993 | Kaule et al. . | |
| 5,516,153 | 5/1996 | Kaule | 283/83 X |

FOREIGN PATENT DOCUMENTS

| | | |
|---|---|---|
| 0019191A | 11/1980 | European Pat. Off. . |
| 0279880 | 8/1988 | European Pat. Off. . |
| 0610917 | 8/1994 | European Pat. Off. . |
| 3236374A | 4/1984 | Germany . |

*Primary Examiner*—Willmon Fridie, Jr.

*Attorney, Agent, or Firm*—Mary R. Bonzagni, Esq.; Holland & Bonzagni, P.C.

[57] ABSTRACT

Security strips or threads are provided which are suitable for at least partial incorporation in and/or for mounting on security documents or means for identification, such as labels, and which comprise the following deposited or laminated layers: at least one layer of a plastic substrate; a layer of a first security detection feature made up of identifying marks or indicia; and a layer of a second security detection feature comprising a generally invisible, optionally repeating pattern. The repeating pattern comprises at least one very thin conductive region and at least one electrically isolating region. Also provided is a security paper having such a security thread at least partially embedded therein and/or mounted on a surface thereof and a process for making the security paper. Further provided is a method of verifying the authenticity and reading the coded information of a security paper employing such a security thread.

15 Claims, 2 Drawing Sheets

MACHINE READABLE AND VISUALLY VERIFIABLE SECURITY THREADS AND SECURITY PAPERS EMPLOYING SAME

FIELD OF THE INVENTION

The present invention relates generally to machine readable and visually verifiable security strips or threads suitable for at least partial incorporation in and/or for mounting on security documents or means for identification, such as labels. The present invention also relates to security papers employing such a thread(s), processes for making such security papers and to methods for their verification.

BACKGROUND OF THE INVENTION

It is known that security papers may be rendered less susceptible to counterfeiting by using invisible, machine-detectable, patterned coatings on the surface of the papers or by including security strips at least partially within the body of the papers. Security strips or threads, as they are commonly referred to, are typically introduced during the manufacture of such security papers and generally take the form of a continuous thread or ribbon of polyester, regenerated cellulose, polyvinyl chloride, or other plastics film coated with a layer of metal and/or magnetic material. In particular, the thread may take the form of: a fully metallized thread, which is presently in wide use in security documents around the world; partially demetallized threads that display positive image metal characters or indicia, currently used in United States Currency; or partially demetallized threads that display negative image or clear characters or indicia that are defined by metal boundaries, currently used in currencies such as the German Deutsche Mark. Security papers employing such partially demetallized threads are described in European Patent No. 0 279 880 while security papers employing partially demetallized threads displaying clear characters are described in U.S. Pat. No. 4,943,093. In addition to the above, the thread may take the form of: a thread coated with a coded pattern of magnetic material and with a layer of either a luminescent or a non-magnetic metal material, as described in U.S. Pat. No. 4,183,989; or may take the form of a thread employing two visible, co-extensive security detection features—namely, a machine-readable repeating pattern and metal-formed indicia, as described in pending U.S. patent application Ser. No. 08/222,657.

Threaded security papers are routinely examined for authenticity by members of the public and verified for authenticity by a variety of devices that include capacitive thread detectors, microwave detectors, eddy current detectors, x-ray detectors (e.g., a scintillation counter) and detectors that depend upon intrinsic magnetic properties such as permeability, retentivity, hysterisis loss and coercivity.

Fully metallized threads, either fully or partially embedded in security papers, are relatively easy to detect by capacitive thread detectors. However, these detectors merely detect the presence or absence of such threads and are easily fooled by lines of conductive material (i.e. pencil lines) on the surface of the document. Moreover, such threads, even when fully embedded in a security paper are visible under reflective illumination. Therefore, a pencil line drawn on the surface of a counterfeit note could easily deceive members of the public into thinking that the document is authentic.

Partially demetallized threads, such as those used in United States Currency, employ a security feature (i.e. metal characters) that can be visually detected only under transmitted illumination and that can be machine detected. However, commercially available thread detectors merely detect the presence or absence of the conductive features or characters on these threads. Due to the small size of the characters, machine reading (i.e., denomination determination) of characters or indicia is extremely difficult. Optical character recognition or other imaging based schemes would have to be employed to ascertain such detailed information.

Partially demetallized threads, such as those used in the German Deutsche Mark, employ a security feature (i.e., clear characters defined by metal boundaries) that can also be visually and machine detected. Such threads have a continuous metal path that extends the entire length of the thread which reportedly makes these threads easier to detect by commercially available thread detectors. However, only the presence or absence of these threads are detected by such detectors. Moreover, it appears that once these documents are in circulation the ability of such detectors to accurately detect the presence of the thread diminishes. This is reportedly due to the presence of cracks or voids present in the continuous metal path that result from handling of the documents. In addition, machine reading such threads would be even more difficult than machine reading the metal characters employed on the United States Currency threads where the detectable metal material merely forms the boundary of the indicia.

Threads coated with a layer of magnetic material and with either a luminescent or a non-magnetic metal material, where the magnetic material is possibly applied in a coded pattern (e.g., magnetic coating applied discontinuously onto a thread with the discontinuities detected with a field detecting device or two different magnetic materials provided in alternating bands along the thread), as described in U.S. Pat. No. 4,183,989, are machine readable but do not offer a public security feature, such as text. Moreover, relying upon the field produced by a certain magnitude or configuration of magnetic materials is problematic in that such coded variations are subject to obliteration by intentional or accidental demagnetization subsequent to the original magnetization. In addition, although magnetic material, such as iron oxide coatings, can be applied discontinuously onto a thread, in a bar code like sequence or in varying depths of coating, to accomplish a machine-readable feature, such application processes require specialty screen printing equipment to apply the iron oxide slurry in defined bars. Moreover, magnetic field array detectors are required to resolve the coded sequence. These array detectors are expensive to manufacture and are particularly problematic for reading threads when banknotes or other documents are processed narrow-edge versus wide-edge where the number of sites on the array that are processed for the wide-edge feed condition are reduced.

U.S. patent application Ser. No. 08/222,657 for "Security Threads Having At Least Two Security Detection Features And Security Papers Employing Same", filed Apr. 4, 1994, discloses a security thread employing two visible and co-extensive security detection features. A first security detection feature comprises a machine-readable repeating pattern made up of at least one metal region and at least one electrically isolating region. A second security detection feature comprises metal-formed indicia. Where the metal regions of the repeating pattern serve to define the boundaries of the metal-formed indicia, the metal of such metal regions would need to have a sufficient thickness to render it visible. The benefit of such a device is that the first and second security detection features can be formed at the same time by depositing metal on a plastic thread or ribbon. However, such visible machine-readable repeating patterns can serve to interfere with the appearance of the visible and co-extensive metal-formed indicia, which serve as the public's means for establishing authenticity.

It is therefore an object of the present invention to provide a security thread that offers a generally invisible or transparent machine-readable security feature and also offers a public security feature.

It is also an object of the present invention to provide a security thread that offers an invisible or transparent machine-readable security feature that: has repeatable portions that extend the length of the thread; that does not interfere with the appearance of the visible security feature located on the thread; that facilitates high-speed machine reading; and that is not subject to obliteration.

It is yet a further object of the present invention to provide a security thread suitable for use with security documents, labels and any other document or means for identification used for purposes which make the verification of the authenticity of each specimen desirable at least once in its lifetime.

SUMMARY OF THE INVENTION

The present invention therefore provides a security thread having a width, suitable for at least partial incorporation in and for use on a security document or means for identification, which comprises the following deposited or laminated layers:

at least one layer of a plastic substrate;

a layer of a first security detection feature; and a layer of a second security detection feature, where the first security detection feature comprises identifying marks or indicia, where the second security detection feature comprises a generally invisible, optionally repeating pattern which comprises at least one very thin conductive region and at least one electrically isolating region, in optionally alternating sequence, and where the electrically isolating region(s) extends across the entire width of the thread.

The present invention further provides a security paper having a first surface and having a security thread, as defined hereinabove, at least partially embedded therein and/or mounted on the first surface.

The present invention also provides a process for making a security paper having a first surface, which process comprises at least partially embedding a security thread, as defined hereinabove, in the security paper and/or mounting the security thread on the first surface of the security paper.

The present invention additionally provides a method of verifying the authenticity and reading the coded information of a security paper containing a security thread, as defined hereinabove, which method comprises identifying, by a machine, the generally invisible, optionally repeating pattern on the thread; and visually detecting the identifying marks or indicia on the thread.

The foregoing and other features and advantages of the present invention will become more apparent from the following description and accompanying drawings.

DESCRIPTION OF THE PREFERRED EMBODIMENT

Figure 1:
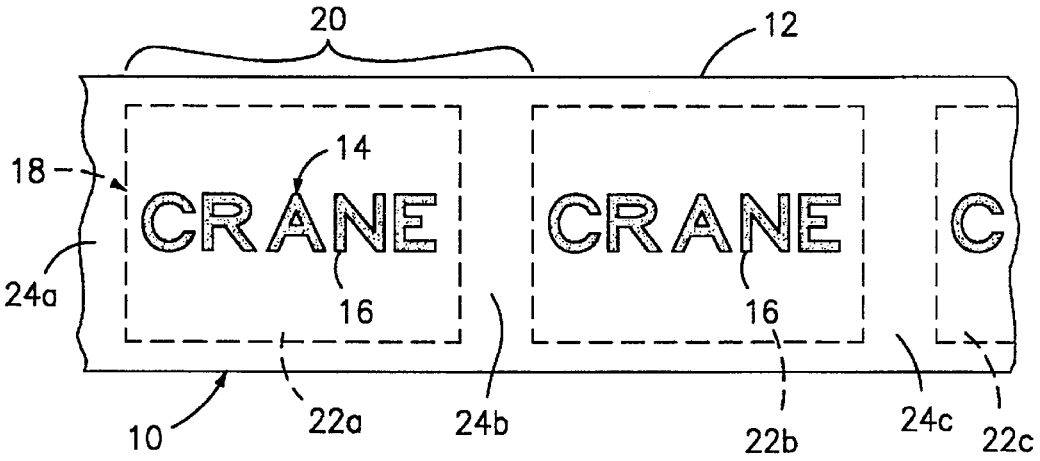
FIG. 1 is a plan view of a preferred embodiment of the security thread according to the present invention.

The present inventive thread will be described hereinbelow mainly in association with security papers, such as banknotes and the like. However, the invention is not so limited. The thread can be used with any document or means for identification for authentication purposes.

The plastic substrate of the present invention may be manufactured from any material having sufficient optical clarity and chemical, mechanical and thermal stability so as to enable it to survive normal conditions of usage of the host security paper. Such materials include polyethylene terephthalate (PET), copolyesters of a dicarboxylic acid moiety and a dihydric alcohol moiety (PETG), polyethersulfone (PES), polyetheretherketone (PEEK), polyester, regenerated cellulose, polyvinyl chloride and other plastics film, with the preferred material being PET. Also contemplated are plastic substrates coated with anti-static materials including conductive materials such as cuprous iodide or with humectant materials such as polymeric quaternary nitrogen and phosphorous compounds, and plastic substrates made up of polymers loaded with conductive metal or graphite particles.

The substrate is preferably made as thin as possible without adversely affecting the handleability of the substrate or its ability to withstand lamination or deposition temperatures. Preferably the substrate has a thickness ranging from about 8 to about 50 microns (μ) for security paper or banknote applications and has a width ranging from about 0.8 to about 3.0 millimeters (mm). The substrate remains intact during the preparation of the inventive security thread and during the papermaking process and does not interfere with the signal seen by an authenticity testing device.

The first security detection feature or public security feature of the present invention comprises identifying marks or indicia. Such identifying marks or indicia also do not interfere with the signal seen by an authenticity testing device and are formed by opaque inks, such as black inks, or are comprised of discrete metal indicia, such as metal characters. Suitable metals for the metal indicia include aluminum and silver. Formation of the opaque ink indicia can be effected by any appropriate transfer mechanism such as printing. Formation of the metal indicia can be performed by any one of a number of methods including, but not limited to, methods involving selective metallization by: electrodeposition; directly hot stamping onto the substrate or onto a layer of the second security detection feature; and using a mask or template in a vacuum metallizer, and methods involving metallization and selective demetallization by: chemical etching; laser etching; and the like. It is preferred that a method involving metallization and selective demetallization be employed such as that method described in U.S. Pat. No. 4,869,778 to Paul F. Cote, which is incorporated herein by reference. It is further preferred that the thickness of such metal indicia range from about 100 to about 400 angstroms (Å). It is also preferred that the metal indicia formed be small enough so as not to create a conductive path that would interfere with the signal(s) seen by an authenticity testing device and sufficiently reflective so as not to be discernable in reflective illumination when the thread is embedded in a security paper. However, such metal indicia, which preferably constitute a term or a phrase, should be large enough so that when the inventive thread is embedded in a security paper, the indicia become legible in transmitted illumination through the paper to the viewing public. In particular, it is preferred that the average width of such indicia range from about 0.10 to about 1.07 mm and that the average height of such indicia range from about 0.45 to about 1.27 mm.

The second security detection feature of the present invention comprises a generally invisible, optionally repeating pattern made up of at least one very thin conductive region and at least one electrically isolating region, in optionally alternating sequence. The electrically isolating region(s) extends across the entire width of the thread.

Suitable materials for use in forming the second security detection feature have high bulk conductivity and include metals, such as aluminum, silver and gold, metal oxides including mixed and pure oxides of indium and tin, and anti-static materials such as conductive materials including copper iodine, humectant materials including polymeric quaternary nitrogen and phosphorous compounds, and polymers loaded with conductive metal or graphite particles. Preferred materials include indium tin oxide, tin oxide-antimony oxide, and antimony oxide.

The very thin conductive region(s) of the optionally repeating pattern of the second security detection feature can adopt any shape or configuration partially or completely occupying the width of the substrate or the width of a layer of the first security detection feature and preferably has a thickness of from about 5 to about 1000 nm and more preferably has a thickness of from about 5 to about 300 nm. For the simple metals, a thickness range of from about 5 to about 30 nm is most preferred. At such thicknesses, the conductive region(s) will be acceptably transparent. In particular, the conductive region(s) generally will have a minimum % light transmittance measurement of greater than 70.00% when measured by an Ultrascan XE spectrophotometer sold by Hunter Associates Laboratory, Inc. of Reston, Va. The surface resistivity of the conductive region (s) is preferably below about 100,000 ohm/square, more preferably below about 10,000 ohm/square when measured by a Keithley Model 614 electrometer sold by Keithley Instruments, Inc. of Cleveland, Ohio.

In a preferred embodiment the very thin conductive region(s) is located on the center plane along the cross section of the plastic substrate and does not completely occupy the width of the substrate. Such positioning of the conductive region(s) renders it more immune to cracking under bending stress, as the region(s) is near the "neutral plane".

The electrically isolating region(s) of the second security detection feature is that region(s) located on the substrate or on a layer of the first security detection feature adjacent to the conductive region(s). As it relates to deposition and selective removal techniques, such regions represent the areas on the thread from which material has been removed. These regions can also adopt any shape or configuration, but must completely extend across the width of the thread so as to avoid the occurrence of a continuous conductive path along the entire length of the thread. In a preferred embodiment where metal indicia are employed, the length of the electrically isolating region(s) is greater than the width of a metal indicia so as to prevent the possibility, during machine reading or detecting, of bridging the region by a metal indicia.

As alluded to above, the second security detection feature can be formed using any one of the methods detailed above for forming the discrete metal indicia of the first security detection feature. It is preferred that formation take place using vacuum evaporation or sputtering techniques followed by selective removal of portions of the deposited layer.

In particular, it is preferred that in forming the second security detection feature that a layer of material be applied to the substrate or to a layer of the first security detection feature, already formed on the substrate, utilizing diode or magnetron sputtering, followed by removing selected portions of the deposited layer by chemical or laser etching.

In a preferred laser etching method, a scanned, focused, high power laser beam is employed. The beam is used to ablate multiple parallel tracks (e.g., 2 to 5 microns in length) which constitute the electrically isolating regions of the second security detection feature. These laser tracks may be made between the indicia or even by cutting tracks irrespective of the indicia since such narrow tracks cut into the indicia would be unnoticeable.

Concurrent formation of the discrete metal indicia and the second security feature on the plastic substrate is also contemplated by the present invention. For example, a layer of material for either the first or second security feature may be applied to the substrate followed by the printed application of an appropriate etch resist to the applied layer. A layer of material for the other security feature is then applied followed by the printed application of an appropriate etch resist to the second applied layer. As will be readily apparent to those skilled in the art, concurrent formation using chemical etching techniques is possible only when compatible chemicals, each targeting separate layers, are employed.

The second security detection feature of the present inventive thread is machine readable as a result of its optionally repeating pattern. Information can be encoded on this layer in a number of ways such as: by the length of the conductive region(s); by the length of the electrically isolating region(s); by the total number of patterns or the total number of conductive regions and/or electrically isolating regions on the thread; by the presence or absence of a conductive region at predetermined positions along the thread; and by the relative conductivity of conductive regions at different positions along the thread. It is preferred that machine readable information be coded by the length of the conductive region(s) or by the number of patterns on the thread.

By way of example and as it relates to banknotes, five separate denominations could be differentiated by threads having a second security detection feature having repeating patterns made up of conductive regions having lengths of 4 mm, 5 mm, 6 mm, 7 mm and 8 mm, respectively. Each denominational thread would have electrically isolating regions of fixed length, for example, 4 mm. Electrically isolating regions of fixed length provide a calibration means for authenticity devices allowing compensation for various reader feed speeds and thread stretch. Moreover, a repeating pattern gives information redundancy that allows for degradation of individual pattern components with little or no effect on the determination of denomination.

Binary code patterns which optionally incorporate error-correction bits are also contemplated. Such patterns would preferably comprise conductive regions having shorter lengths of approximately 2 or 3 mm, which would allow several pattern repeats along the thread for the purpose of information redundancy.

Specific reference is now made to FIG. 1 which depicts a preferred embodiment of the security thread according to the present invention, which is shown generally at 10. The thread 10 comprises a layer of a plastic substrate 12, a layer of a first security detection feature 14 made up of identifying marks or indicia 16, and a layer of a second security detection feature 18. The second security detection feature 18 is located on the substrate 12 and is made up of a generally invisible, repeating pattern 20, which comprises very thin conductive regions 22*a*, 22*b*, 22*c*, that adopt a rectangular configuration contained within the region of the thread 10 defined by its width, and electrically isolating regions 24*a*, 24*b*, 24*c*, that extend across the entire width of the thread 10. The indicia 16 are located on the conductive regions 22*a*, 22*b*, 22*c*.

Figure 2:
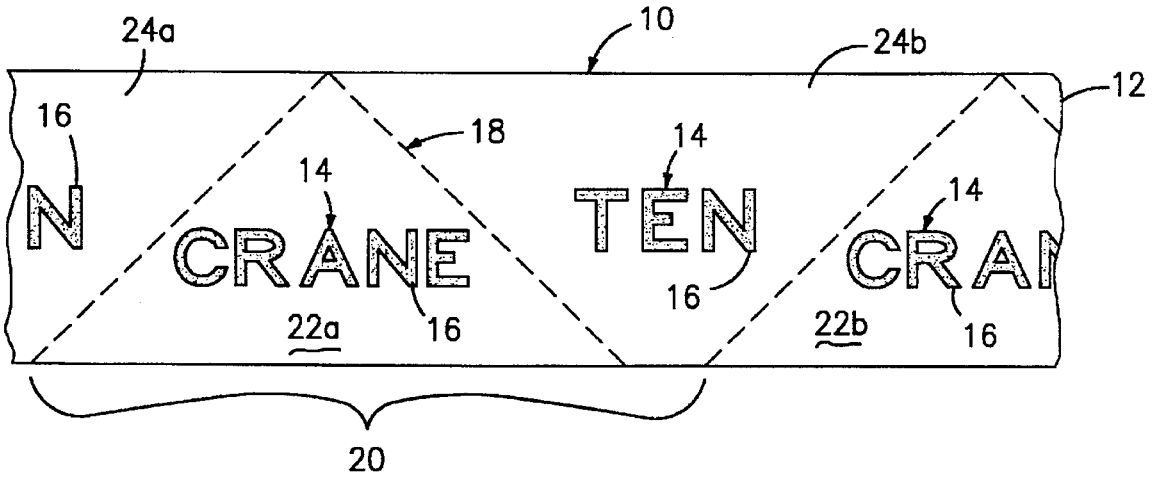
FIG. 2 is a plan view of another preferred embodiment of the present inventive security thread.

FIG. 2 represents another embodiment of the present inventive thread 10. In this embodiment, the conductive regions 22*a*, 22*b* adopt a triangular configuration that extends across the entire width of the thread 10. In addition, the indicia 16 are located on both the conductive regions 22*a*, 22*b* and on the electrically isolating regions 24*a*, 24*b*.

Figure 3:
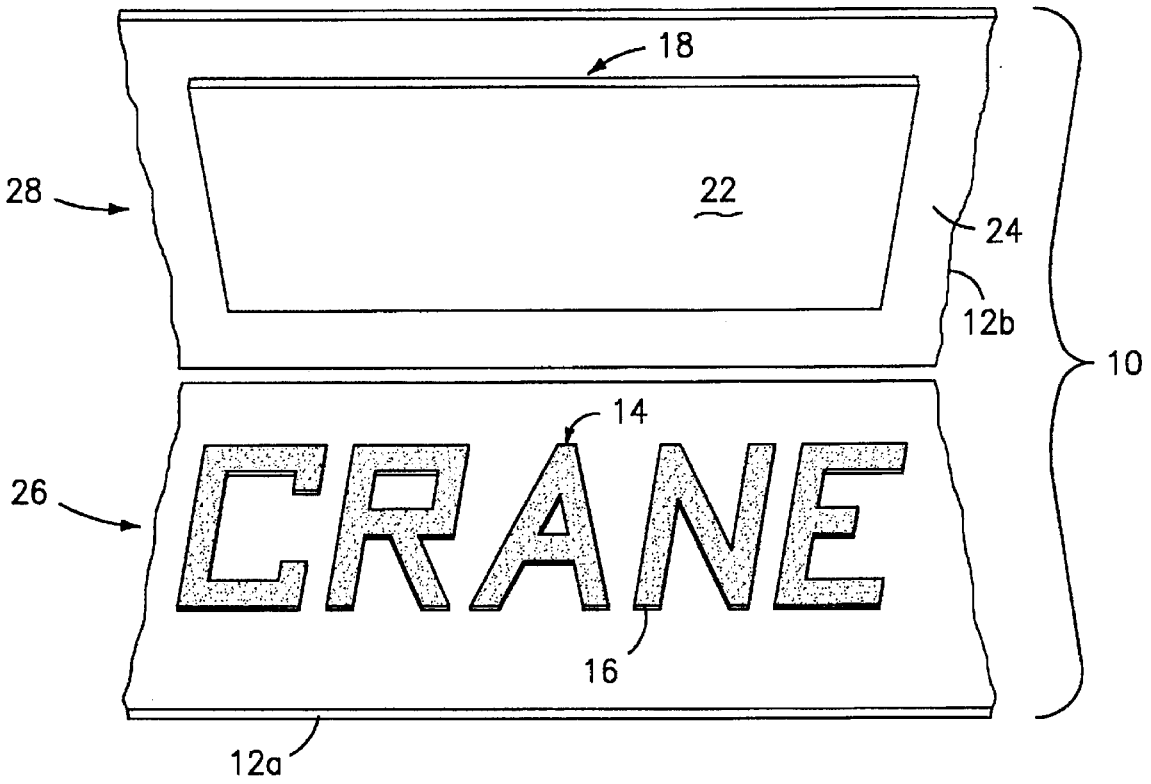
FIG. 3 is a prospective view of two prepared composite layers of a preferred four layer security thread prior to a lamination or gluing step.

FIG. 3 depicts the prepared composite layers of a more preferred four layer thread 10 prior to a lamination or gluing step.

A first prepared composite layer 26 comprises a layer of a plastic substrate 12*a* and a layer of a first security detection feature 14 made up of discrete metal indicia 16. It is preferred that aluminum metal be vacuum deposited to a thickness of about 30 nm onto substrate 12*a* and that a "resist and etch" technique, as described in the Cote patent, be employed to form the metal indicia 16. In a more preferred embodiment, aluminum is vacuum deposited onto a roll of MYLAR® film having a thickness of about 12 microns and printed with a etch resist such as a U.V. polymerized coating composition available from Sun Chemical Corp., 222-T Bridge Plaza South, P.O. Box 1302, Fort Lee, N.J. 07024, under the product designation RCA 01283R. The aluminum is then etched by a basic etch, such as a 1 to 5 molar sodium hydroxide solution at room temperature, or warmed.

A second prepared composite layer 28 comprises a layer of a plastic substrate 12*b* and a layer of a second security detection feature 18. It is preferred that indium tin oxide be sputtered onto substrate 12*b* to a thickness of between about 5 to about 1000 nanometers to form the conductive region(s) 22 of the second security detection feature 18. A U.V. etch resist, as described above, is then printed onto the deposited indium tin oxide layer and the layer etched by an acid etch, such as a mixture of dilute (10%) nitric and hydrochloric acids or dilute hydrobromic acid or a mixture of ferric chloride and hydrochloric acid, all at room temperature, or warmed.

Once the first and second security detection features 14, 18 are formed on the respective substrates 12*a*, 12*b*, the prepared composite layers 26, 28 are laminated or glued such that the layer of the first security detection feature 14 and the layer of the second security detection feature 18 constitute inner layers. No registration of the first and second security detection features 14, 18 is required.

Figure 4:
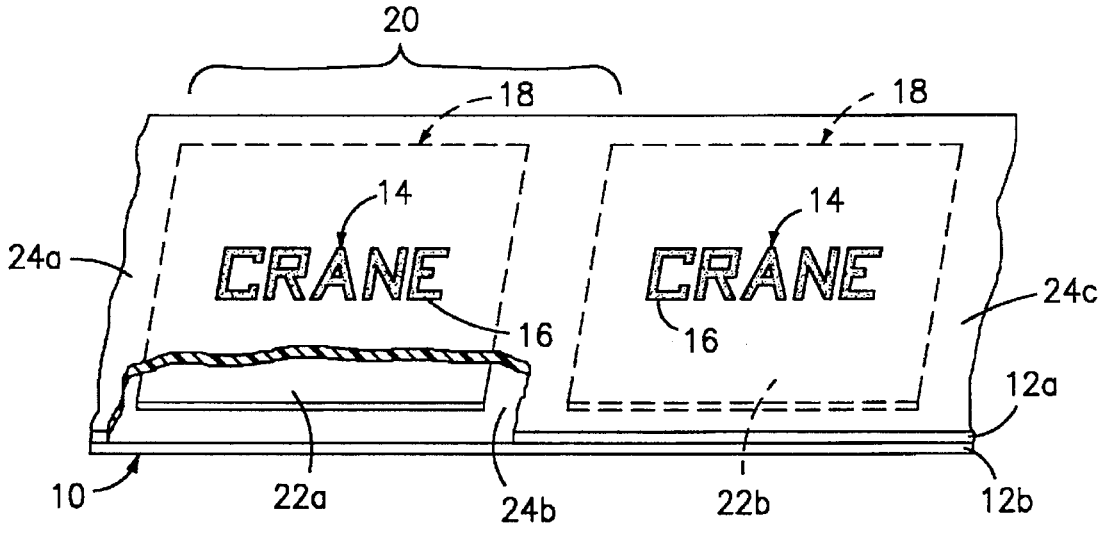
FIG. 4 is a top prospective view of the four layer security thread of FIG. 3, once a lamination or gluing step has taken place, showing a cut-away section that reveals a layer of plastic substrate and a portion of a layer of the second security detection feature.

The preferred four-layer laminated thread 10 of the present invention is shown in FIG. 4.

The present inventive thread 10 may include additional components and/or layers such as: adhesive layers, that serve to improve or modify the physical or mechanical properties of the thread 10 and/or support its incorporation into a security paper; and components and/or layers that serve to provide the thread 10 with waterproofing, passivation, heat resistance and optical effects such as color matching or camouflage, provided such additional components and/or layers do not interfere with the signal seen by an authenticity testing device.

The security thread 10 according to the present invention may be at least partially incorporated in security papers during manufacture by techniques commonly employed in the paper-making industry. For example, the inventive thread 10 may be pressed within wet paper fibers while the fibers are unconsolidated and pliable, as taught by U.S. Pat. No. 4,534,398, resulting in the thread being totally embedded in the resulting paper. The thread 10 may also be fed into a cylinder mold papermaking machine, cylinder vat machine, fourdrinier papermaking machine, or similar machine of known type, resulting in partial embedment of the thread within the body of the finished paper (i.e., windowed paper). In addition to the above, the security thread 10 of the present invention may be mounted on the surface of security documents either during or post manufacture. Mounting of the thread 10 may be achieved by any number of known techniques including: applying a pressure-sensitive adhesive to a surface of the thread 10 and pressing the thread 10 to the surface of the document; and applying a heat activated adhesive to a surface of the thread 10 and applying the thread 10, using thermal transfer techniques, to the surface of the document.

The detection and reading of the identifying marks or indicia 16 of the first security detection feature 14, in accordance with the method of the present invention, may be carried out by members of the general public, by viewing an exposed portion of the thread 10 directly or by viewing, in transmitted illumination, an embedded portion of the thread 10. In addition, metal indicia 16 may be detected and read using non-visual methods of detection, including machine optical character recognition (OCR) or other imaging-based schemes.

The detection and reading of the coded information or optionally repeating pattern 20 of the second security detection feature 18, in accordance with the method of the present invention, may be carried out, for example, by detection devices that depend upon intrinsic metal properties of a metallized security thread (i.e., dielectric properties, resonance frequencies). Such devices include capacitive and microwave-based verification devices. For example, the detection and reading of the optionally repeating pattern 20 may be performed by: detecting and recording the changes in capacitance (i.e., detection signature) that occur when the subject thread embedded paper is passed over a set of metallic electrodes; comparing the detection signature with detection signatures for known types of authentic documents; verifying the authenticity of the document; and, if authentic, reporting the type of authentic document having a matching detection signature. Such capacitance detectors are available from Authentication Technologies, Inc., 6670 Amador Plaza Road, Suite 204, Dublin, Calif. 94568.

The detection and reading of the second security detection feature 18 may also be performed by: detecting and recording the changes in radiated power (i.e., detection signature) of microwaves from a source of known power (e.g., 1 to 20 Gigahertz (GHz)) through the paper; comparing and verifying the authenticity of the detection signature obtained; and then, if authentic, reporting the type of authentic document processed. Such microwave detectors are also available from Authentication Technologies, Inc.

It should be understood by those skilled in the art that obvious modifications can be made without departing from the spirit of the invention. Accordingly, reference should be made primarily to the accompanying claims, rather than the foregoing specification, to determine the scope of the invention.

Having thus described the invention, what is claimed is:

1. A security thread having a width, suitable for at least partial incorporation in and for use on a security document or means for identification, which comprises the following deposited or laminated layers:

at least one layer of a plastic substrate;

a layer of a first security detection feature; and a layer of a second security detection feature, wherein said first security detection feature comprises identifying marks or indicia, wherein said second security detection feature comprises a generally invisible, optionally repeating pattern which comprises at least one very thin conductive region and at least one electrically isolating region, in optionally alternating sequence, and wherein said electrically isolating region(s) extends across the entire width of said thread.

2. A security paper having a security thread at least partially embedded therein or mounted thereon, wherein said security thread has a width and comprises the following deposited or laminated layers:

at least one layer of a plastic substrate;

a layer of a first security detection feature; and a layer of a second security detection feature, wherein said first security detection feature comprises identifying marks or indicia, wherein said second security detection feature comprises a generally invisible, optionally repeating pattern which comprises at least one very thin conductive region and at least one electrically isolating region, in optionally alternating sequence, and wherein said electrically isolating region(s) extends across the entire width of said thread.

3. The security thread of claims 1 or 2 which is a four layer security thread comprised of:

a. a first plastic substrate layer, which is adhered to:

b. a layer of the first security detection feature, which is laminated to:

c. a layer of the second security detection feature, which is adhered to:

d. a second plastic substrate layer.

4. The security thread of claims 1 or 2 which is a four layer security thread comprised of:

a. a first plastic substrate layer, which is laminated to:

b. a layer of the first security detection feature, which is adhered to:

c. a layer of the second security detection feature, which is adhered to:

d. a second plastic substrate layer.

5. The security thread of claims 1 or 2 wherein said very thin conductive region(s) of said optionally repeating pattern has a thickness of from about 5 to about 1000 nanometers, a % Transmittance of 70.00 minimum and a surface resistivity of below about 100,000 ohm/square.

6. The security thread of claims 1 or 2 wherein said very thin conductive region(s) of said optionally repeating pattern comprises a material selected from the group consisting of: metals including aluminum, silver and gold; metal oxides including mixed and pure oxides of indium and tin; antistatic materials including copper iodine; humectant materials including polymeric quaternary nitrogen and phosphorous compounds; and polymers loaded with conductive metal particles.

7. The security thread of claim 6 wherein said material of said very thin conductive region(s) of said optionally repeating pattern is indium tin oxide.

8. The security thread of claims 1 or 2 wherein said identifying marks or indicia are opaque ink indicia.

9. The security thread of claims 1 or 2 wherein said identifying marks or indicia are discrete metal indicia.

10. The security thread of claim 9 wherein the metal of said discrete metal indicia is aluminum.

11. The security thread of claim 9 wherein said discrete metal indicia and said optionally repeating pattern are produced by a process involving selective deposition or by a process involving deposition and selective removal.

12. A process for making a security paper, which process comprises at least partially embedding therein a security thread having a width and comprising the following deposited or laminated layers:

at least one layer of a plastic substrate;

a layer of a first security detection feature; and a layer of a second security detection feature, wherein said first security detection feature comprises identifying marks or indicia, wherein said second security detection feature comprises a generally invisible, optionally repeating pattern which comprises at least one very thin conductive region and at least one electrically isolating region, in optionally alternating sequence, and wherein said electrically isolating region(s) extends across the entire width of said thread.

13. A method of verifying the authenticity and reading coded information of a security paper containing a security thread comprising a layer of a first security detection feature and a layer of a second security detection feature deposited on or laminated to at least one plastic substrate having a width, which method comprises: identifying, by a machine, a generally invisible, optionally repeating pattern which comprises at least one very thin conductive region and at least one electrically isolating region, in optionally alternating sequence, wherein said electrically isolating region(s) extends across the entire width of said substrate, which optionally repeating pattern is said second security detection feature; and visually detecting identifying marks or indicia, which indicia is said first security detection feature.

14. The method of claim 13 wherein said optionally repeating pattern is identified by a capacitive detector.

15. The method of claim 13 wherein said optionally repeating pattern is identified by a microwave detector.

* * * * *